US007874691B2

(12) United States Patent
Kormos

(10) Patent No.: US 7,874,691 B2
(45) Date of Patent: Jan. 25, 2011

(54) LIGHT EMITTING DEVICE FOR DIVERS

(76) Inventor: Laszlo Kormos, Herrhagsvägen 31, Nyköping (SE) 611 46

( * ) Notice: Subject to any disclaimer, the term of this patent is extended or adjusted under 35 U.S.C. 154(b) by 199 days.

(21) Appl. No.: 12/223,703

(22) PCT Filed: Jan. 31, 2007

(86) PCT No.: PCT/SE2007/000079

§ 371 (c)(1),
(2), (4) Date: Sep. 19, 2008

(87) PCT Pub. No.: WO2007/097678

PCT Pub. Date: Aug. 30, 2007

(65) Prior Publication Data

US 2009/0059568 A1 Mar. 5, 2009

(30) Foreign Application Priority Data

Feb. 23, 2006 (SE) ..... 0600392

(51) Int. Cl.
*F21V 33/00* (2006.01)

(52) U.S. Cl. ..... 362/101; 362/84; 362/253; 362/234

(58) Field of Classification Search ..... 362/84, 362/94, 101, 253, 234; 128/200.29, 201.11, 128/201.22, 201.23, 201.27; 405/185–194; 114/315, 318, 327, 329, 334
See application file for complete search history.

(56) References Cited

U.S. PATENT DOCUMENTS

| | | | | |
|---|---|---|---|---|
| 4,336,591 | A * | 6/1982 | Berdzar et al. | 73/291 |
| 4,623,316 | A * | 11/1986 | Ratliff | 441/106 |
| 4,889,306 | A * | 12/1989 | Boucher | 248/313 |
| 5,579,967 | A * | 12/1996 | Berg | 224/250 |
| 5,913,467 | A * | 6/1999 | Berg | 224/628 |
| 6,019,480 | A | 2/2000 | Polkow | |
| 6,856,578 | B2 * | 2/2005 | Magine et al. | 367/134 |
| 7,178,931 | B1 | 2/2007 | Murphy | |
| 2001/0021108 | A1 * | 9/2001 | Shimada et al. | 362/103 |
| 2002/0075674 | A1 | 6/2002 | Tufte | |
| 2004/0042200 | A1 | 3/2004 | Hurwitz | |

FOREIGN PATENT DOCUMENTS

| | | |
|---|---|---|
| GB | 2288897 | 11/1995 |
| WO | WO 0013750 A1 | 3/2000 |

* cited by examiner

*Primary Examiner*—Sandra L. O'Shea
*Assistant Examiner*—Danielle Allen
(74) *Attorney, Agent, or Firm*—Buchanan Ingersoll & Rooney PC

(57) ABSTRACT

A light emitting device (1), which is adapted to be attached to at least one air cylinder (2, 3) that is to be carried by a diver, such as a scuba diver or a smoke diver, comprises an electroluminescent filament and a protective cover enclosing the filament and made of translucent, heat resistant silicone material. The light emitting device (1) further comprises resilient fastening elements (4*a*, 4*b*), which are arranged to secure the light emitting device (1) to the air cylinder/cylinders (2, 3) by a force determined by the resilient properties of the fastening elements.

3 Claims, 3 Drawing Sheets

LIGHT EMITTING DEVICE FOR DIVERS

FIELD OF THE INVENTION

The present invention relates to a safety device for locating a diver in a difficult environment and concerns especially a light emitting device, which is adapted to be attached to at least one air cylinder that is to be carried by a diver, such as a scuba diver or a smoke diver.

BACKGROUND ART

Smoke divers usually work in extremely difficult conditions in environments where the temperature is very high due to fire and visibility is very poor due to smoke from a fire and where besides the noise level is high due to fire extinguishing operations. Scuba divers also sometimes work in difficult conditions with poor visibility. Smoke divers, but also scuba divers working in difficult conditions, therefore mostly work in pairs, and of course it is necessary for both individuals in each pair to have contact with each other while performing the work. This is particularly important for security reasons. If one of the divers should be injured or in some other way get into danger, it is necessary that the other diver's attention can be quickly drawn to this so that he can rescue his colleague.

The smoke divers are often provided with a communication radio system to be able to communicate with each other. However, this does not function if one of them has become unconscious or for some other reason is not capable of using his radio equipment. A prior art alarm device consists of a box which the smoke diver carries on his stomach and which emits an acoustic signal if the smoke diver is lying or for some other reason has not performed an activity for a period of time of about 20 s. The emitted acoustic signal is, however, not always a sufficient aid to quickly locating a diver in danger. A further prior art device for locating a smoke diver in danger is a unit, which is provided with flashing light emitting diodes and which the smoke diver also carries on his stomach. Such light emitting diodes have a short range in a space filled with smoke from a fire and, in addition, they are completely shielded if the smoke diver's back is directed towards the person looking for him, or if he is lying face down.

Thus, there is a great need for a device that functions well in the above described difficult environments and is adapted to locate in particular a smoke diver, but also a scuba diver.

SUMMARY OF THE INVENTION

The object of the present invention therefore is to provide a device which is adapted to locate a diver, such as a smoke diver or a scuba diver, and which resists high temperatures and functions in spaces filled with smoke from a fire and which besides is easy to apply and use.

According to the present invention, this object is achieved by a light emitting device, which is of the type stated by way of introduction and characterised in that it comprises an electroluminescent filament and a protective cover enclosing the filament and made of a translucent, heat resistant silicone material, the light emitting device further comprising a resilient fastening means, which is arranged to secure the light emitting device to the air cylinder/cylinders by a force determined by the resilient properties of the fastening means.

In a preferred embodiment, the filament with the protective cover is placed in a groove in a stainless steel support rail extending along the protective cover.

The filament can be connected to a battery-operated power source in the form of a DC/AC converter, which is also enclosed by the protective cover.

In a special embodiment, the light emitting device is adapted to be attached to a set of cylinders consisting of two parallel air cylinders and preferably has the shape of a U, whose one leg is adapted to be releasably fastened to one of the air cylinders by at least a first resilient fastening element included in the fastening means and whose other leg is adapted to be releasably fastened to the other air cylinder by at least a second resilient fastening element included in the fastening means.

BRIEF DESCRIPTION OF THE DRAWINGS

The invention will now be described in more detail with reference to the accompanying drawings.

DESCRIPTION OF A PREFERRED EMBODIMENT

Figure 1:
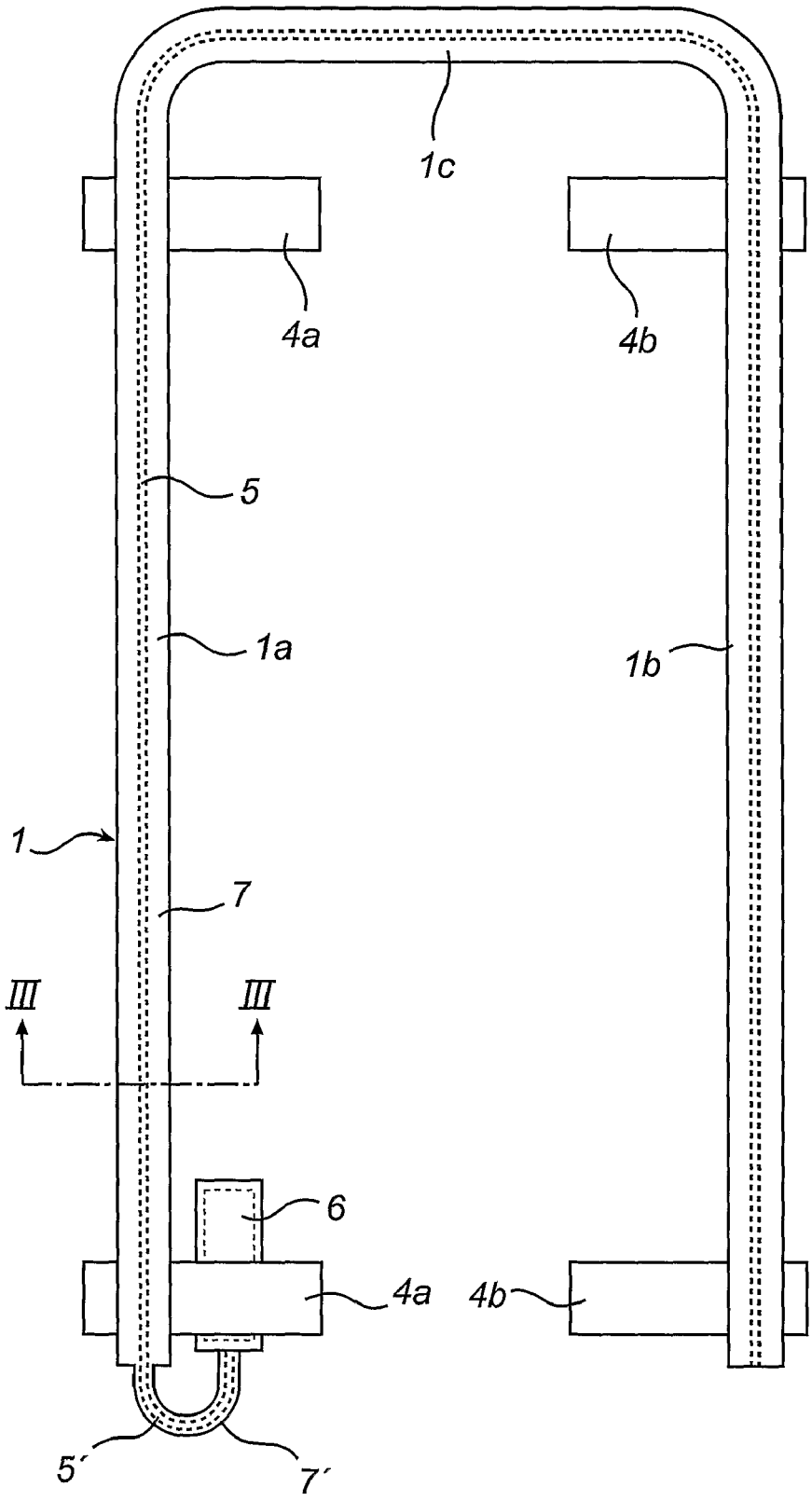
FIG. 1 is a schematic top plan view and illustrates a light emitting device according to the invention.
Figure 2:
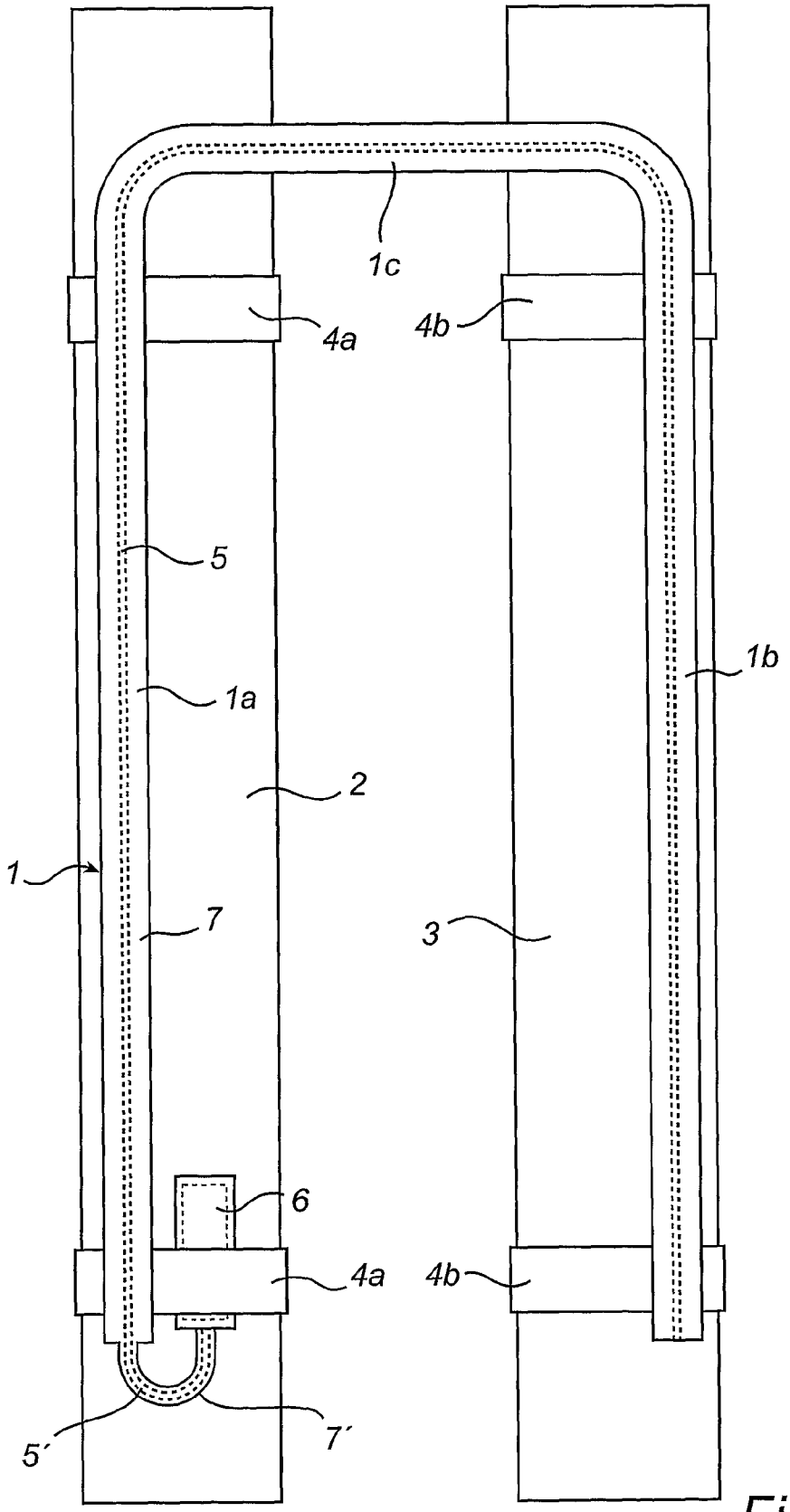
FIG. 2 is a schematic top plan view and shows the light emitting device shown in FIG. 1 applied to two air cylinders.
Figure 3:
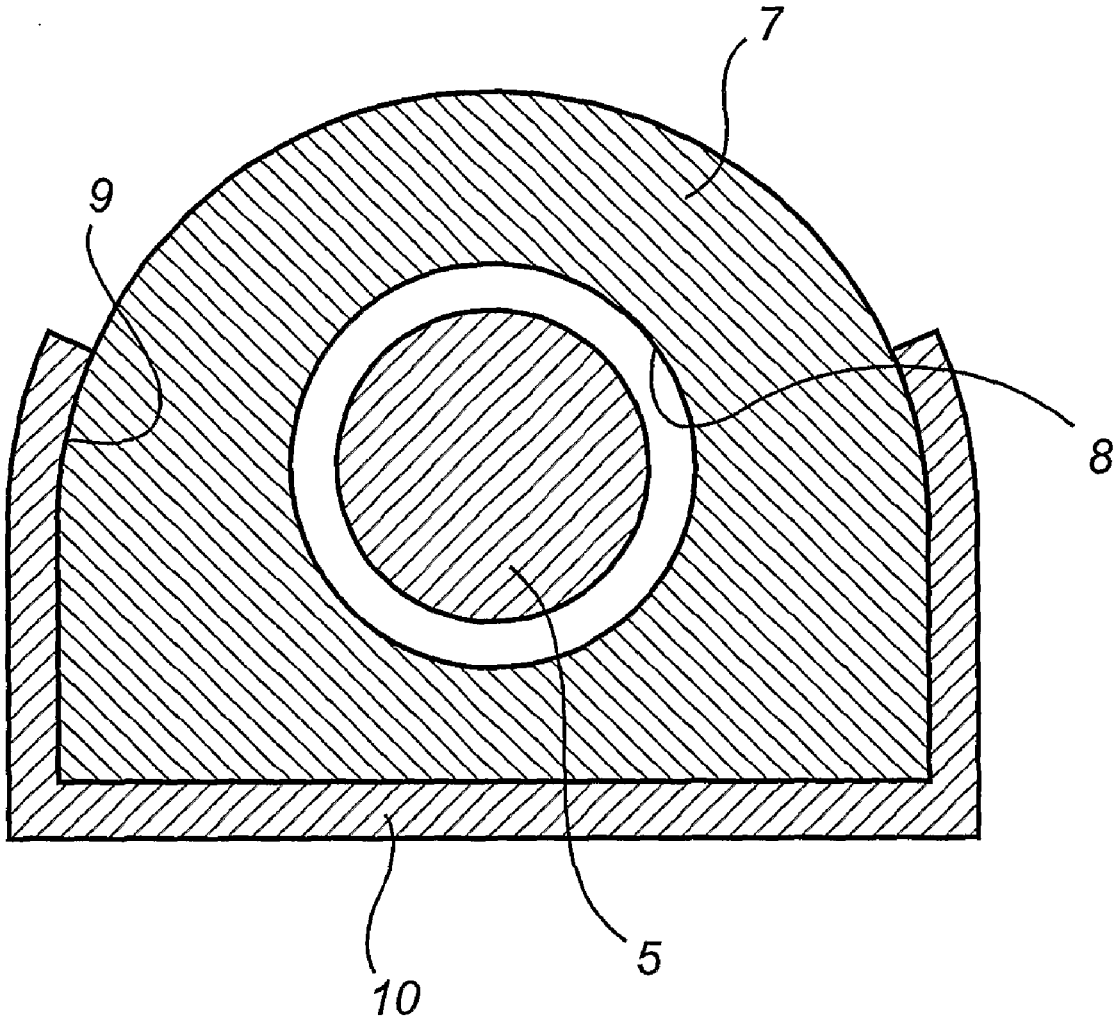
FIG. 3 is an enlarged sectional view along the line III-III in FIG. 1.

The light emitting device 1 according to the invention, which is schematically illustrated in the drawings, is in FIG. 2 shown applied to a set of cylinders consisting of two parallel, substantially circular-cylindrical air cylinders 2 and 3, which a smoke diver or a scuba diver carries on his back. The two air cylinders 2 and 3 are in a way not shown in detail connected to each other. As will be evident, the light emitting device 1 is shown in a carried position from behind in FIG. 2 and in a corresponding position in FIG. 1.

The light emitting device 1 is substantially U-shaped, its legs 1*a* and 1*b* being slightly shorter than the air cylinders 2 and 3 and its U web 1*c* being slightly longer than the centre distance between the air cylinders 2 and 3.

Each of the legs 1*a* and 1*b* of the light emitting device 1 supports two resilient fastening elements 4*a* and 4*b* of stainless steel. Each fastening element 4*a* and 4*b* is substantially circular-arc-shaped and has an extent in the circumferential direction which is greater than 180°. The inner diameter of the fastening elements 4*a* and 4*b* is substantially equal to the outer diameter of the air cylinders 2 and 3. The fastening elements 4*a* and 4*b* are snapped onto the air cylinders and together form a resilient fastening means, which by a force determined by the resilient properties of the fastening elements 4*a* and 4*b* secures the light emitting device 1 in a releasable manner to the air cylinders 2 and 3.

If the light emitting device 1 should hook to a stationary object, the diver carrying the set of cylinders 2, 3 provided with the light emitting device 1 can thus with a simple jerk relieve himself from the light emitting device 1 hooked to the object since, due to the jerk, the light emitting device comes loose from the set of cylinders 2, 3.

The main component of the light emitting device 1 is a per se known electroluminescent filament 5, which here is of the type sold by ELAM EL Industries Ltd, Israel, under the trademark LYTEC®. This filament has a luminescent phosphorus layer between two conductive electrodes. For use in spaces filled with smoke from a fire, it has been found particularly convenient to use a filament 5 emitting blue-green light, whereas in muddy water yellow or read light is probably best suited. A battery-operated power source 6 in the form of a DC/AC converter belongs to the filament 5, to which the filament is connected.

The light emitting device 1 further comprises a substantially U-shaped string 7 of translucent, heat resistant silicone material. The string 7 has an inner passage 8 which extends along the string from one end thereof (the free end of the leg 1*a*) to the other end (the free end of the leg 1*b*), where the passage 8 is, however, closed. The filament 5 is placed in the passage 8 of the string 7 and extends from the closed end of the string to its "open" end, where an end portion 5' of the filament 5 protrudes, which end portion is connected to the power source 6. The protruding end portion 5' of the filament 5 and the power source 6 are enclosed in an extension 7' of the string 7, which extension is made of the same material as the string. The translucent, heat resistant silicone material, of which the protective cover consisting of the string 7 and its extension 7' is made by injection moulding and vulcanisation, is here a silicone material which is sold by Wacker-Chemie AG, Germany, under the designation ELASTOSIL®R 402 and which for about 1 hour withstands a temperature as high as about 300° C. and for 8-10 s withstands a temperature of 800-900° C.

The substantially U-shaped string 7 with the filament 5 enclosed by the same is inserted into a groove 9 in a stabilising support rail 10 of stainless steel which has the same U shape as the string 7. The support rail 10 is spot-welded to the fastening elements 4*a*, 4*b*.

The invention claimed is:

1. A light emitting device, which is attached to a set of air cylinders that is carried by a diver, such as a scuba diver or a smoke diver, the set of air cylinders having two parallel air cylinders, the light emitting device comprising an electroluminescent filament and a protective cover enclosing the filament and made of translucent, heat resistant silicone material, the light emitting device further comprising resilient fastening elements, which secure the light emitting device to the cylinders by a force determined by the resilient properties of the fastening elements, the light emitting device having the shape of a U, whose one leg is releasably fastened to one of the air cylinders by at least a first resilient fastening element and whose other leg is releasably fastened to the other air cylinder by at least a second resilient fastening element.

2. A light emitting device as claimed in claim 1, in which the filament with the protective cover is placed in a groove in a stainless steel support rail extending along the protective cover.

3. A light emitting device as claimed in claim 1, in which the filament is connected to a battery-operated power source in the form of a DC/AC converter, which is also enclosed by the protective cover.

* * * * *